US010138683B2

(12) United States Patent
Strachan

(10) Patent No.: US 10,138,683 B2
(45) Date of Patent: Nov. 27, 2018

(54) DIRECTIONAL CASING-WHILE-DRILLING

(71) Applicant: Halliburton Energy Services, Inc., Houston, TX (US)

(72) Inventor: Michael John Strachan, Conroe, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 86 days.

(21) Appl. No.: 14/655,764

(22) PCT Filed: Dec. 5, 2013

(86) PCT No.: PCT/US2013/073352

§ 371 (c)(1),
(2) Date: Jun. 26, 2015

(87) PCT Pub. No.: WO2015/084374

PCT Pub. Date: Jun. 11, 2015

(65) Prior Publication Data

US 2015/0330150 A1 Nov. 19, 2015

(51) Int. Cl.
*E21B 7/20* (2006.01)
*E21B 7/06* (2006.01)
(Continued)

(52) U.S. Cl.
CPC ..... *E21B 7/067* (2013.01); *E21B 7/062* (2013.01); *E21B 7/20* (2013.01); *E21B 17/1014* (2013.01); *E21B 17/20* (2013.01); *E21B 47/00* (2013.01)

(58) Field of Classification Search
CPC ..... E21B 7/203; E21B 7/062
See application file for complete search history.

(56) References Cited

U.S. PATENT DOCUMENTS 5,065,826 A 11/1991 Kruger et al.
6,352,128 B1 3/2002 Puttman
(Continued)

FOREIGN PATENT DOCUMENTS

CN 1299915 A 6/2001

OTHER PUBLICATIONS

International Preliminary Report on Patentability issued in related Application No. PCT/US2013/073352, dated Jun. 16, 2016 (9 pages).

(Continued)

*Primary Examiner* — Robert E Fuller
(74) *Attorney, Agent, or Firm* — Alan Bryson; Baker Botts L.L.P.

(57) ABSTRACT

A directional casing-while-drilling system includes a rotary steerable system disposed within a casing string used as a drill string during casing-while-drilling operations. The casing string of some embodiments may include an upper section and a lower section coupled by a swivel, which may enable the upper section of the casing string to be rotated without substantially rotating the lower section. The rotary steerable system may be disposed at least partially within the lower section of the casing string, and coupled to a drill bit and/or under-reamer. The rotary steerable system may enable radial diversion of the drill bit and/or under-reamer, for example by actuation of one or more components in the rotary steerable system.

22 Claims, 10 Drawing Sheets

(51) Int. Cl.

| | |
|---|---|
| ***E21B 17/20*** | (2006.01) |
| ***E21B 47/00*** | (2012.01) |
| ***E21B 17/10*** | (2006.01) |

(56) References Cited

U.S. PATENT DOCUMENTS

| | | | | |
|---|---|---|---|---|
| 6,419,033 | B1 * | 7/2002 | Hahn | E21B 7/062 175/171 |
| 2003/0121702 | A1 | 7/2003 | Downton et al. | |
| 2004/0104051 | A1 | 6/2004 | Moriarty et al. | |
| 2005/0126825 | A1 | 6/2005 | Moriarty et al. | |
| 2005/0236187 | A1 | 10/2005 | Chen et al. | |
| 2006/0254819 | A1 | 11/2006 | Moriarty | |
| 2009/0166089 | A1 | 7/2009 | Millet | |
| 2013/0043076 | A1 | 2/2013 | Larronde et al. | |

OTHER PUBLICATIONS

Jones, et al., "Concurrent Rotary-Steerable Directional Drilling and Hole Enlargement Applied Successfully: Case Studies in North Sea, Mediterranean Sea, and Nile Delta", IADC/SPE 112670, Mar. 2008.
Srinivasan, et al., "New Directional Drilling with Liner Systems Allow Logging and Directional Control While Getting Casing Across Trouble Zones", SPE 131391, Jun. 2010.
Chima, et al., "Casing Drilling Technology Application: Case Histories from Saudi Arabia", SPE 160857, Apr. 2012.
International Search Report and Written Opinion in related application PCT/US2013/073352, dated Sep. 1, 2014. 13 pages.
Office Action issued in related Chinese Application No. 201380080115.X, dated Nov. 30, 2016 (13 pages).

* cited by examiner

DIRECTIONAL CASING-WHILE-DRILLING

CROSS-REFERENCE TO RELATED APPLICATION

The present application is a U.S. National Stage Application of International Application No. PCT/US2013/073352 filed Dec. 5, 2013, which is incorporated herein by reference in its entirety for all purposes.

BACKGROUND

The present disclosure relates generally to subterranean drilling operations and, more particularly, to directional drilling operations and tools therefor.

Hydrocarbons, such as oil and gas, are commonly obtained from subterranean formations that may be located onshore or offshore. The development of subterranean operations and the processes involved in removing hydrocarbons from a subterranean formation are complex. Typically, subterranean operations involve a number of different steps such as, for example, drilling a wellbore at a desired well site, treating the wellbore to optimize production of hydrocarbons, and performing the necessary steps to produce and process the hydrocarbons from the subterranean formation.

A wellbore may be drilled using a drill bit attached to the end of a generally hollow, tubular drill string extending from an associated well surface. Rotation of the drill bit progressively cuts away adjacent portions of a downhole formation using cutting elements and cutting structures disposed on exterior portions of the drill bit. After the wellbore is drilled, a subsequent casing operation may be performed to install metal casing along selected portions of the wellbore and cement the casing in place. In other methods, so-called casing drilling may instead be employed, wherein the casing string itself is used as the drill string during drilling. This can be accomplished, e.g., by imparting rotation to the casing, which is operatively coupled to the drill bit so as to impart rotation to the bit, as well.

In some instances, cased drilling can instead or in addition be carried out through use of a down-hole mud-motor or positive displacement motor (PDM), which may be part of a bottom hole assembly (BHA) located on the drill string proximate to a downhole end of the drill string. Such a motor may be coupled (e.g., latched) to the casing string proximate to a bottom end of the casing string, and further operatively coupled to the drill bit. The motor may be actuated (e.g., by mud flow through the motor) so as to impart rotation on the drill bit, without requiring rotation of the casing string. Cased drilling may eliminate the need to remove the drill string (sometimes referred to as "tripping" or "tripping out" the drill string) in order to insert casing into the borehole (sometimes referred to as "running pipe"); the casing is already inserted into the borehole as drilling progresses.

A BHA in cased or non-cased drilling may include a device or devices for implementing directional drilling, that is, the steering of the drill bit. Steering the drilling assembly may be useful for various reasons, such as to avoid particular formations or to intersect formations of interest. Steering the drilling assembly includes changing the direction in which the drilling assembly/drill bit is pointed. An example of a directional drilling device is a Rotary Steerable System (RSS), which may cause axial deviation of the drill bit in various ways, such as "point-the-bit" or "push-the-bit." In a typical "point-the-bit" system, changing the direction in which the drilling assembly/drill bit is pointed includes exerting a force on a flexible drive shaft connected to a drill bit. In a typical "push-the-bit" system, changing the direction in which the drilling assembly/drill bit is pointed includes exerting a force on the borehole wall.

Steering the bit can result in drilling a deviated borehole from a straight section of the wellbore. In a simplified application, the wellbore is a straight vertical hole, and a drilling operator desires to drill a deviated borehole off the straight wellbore, e.g., in order to thereafter drill substantially horizontally in an oil- or gas-bearing formation, or other subterranean formation. The deviation need not necessarily result in horizontal drilling, of course, as other degrees of deviation from a vertical wellbore may be employed in directional drilling.

FIGURES

Some specific exemplary embodiments of the disclosure may be understood by referring, in part, to the following description and the accompanying drawings.

Figure 1A:
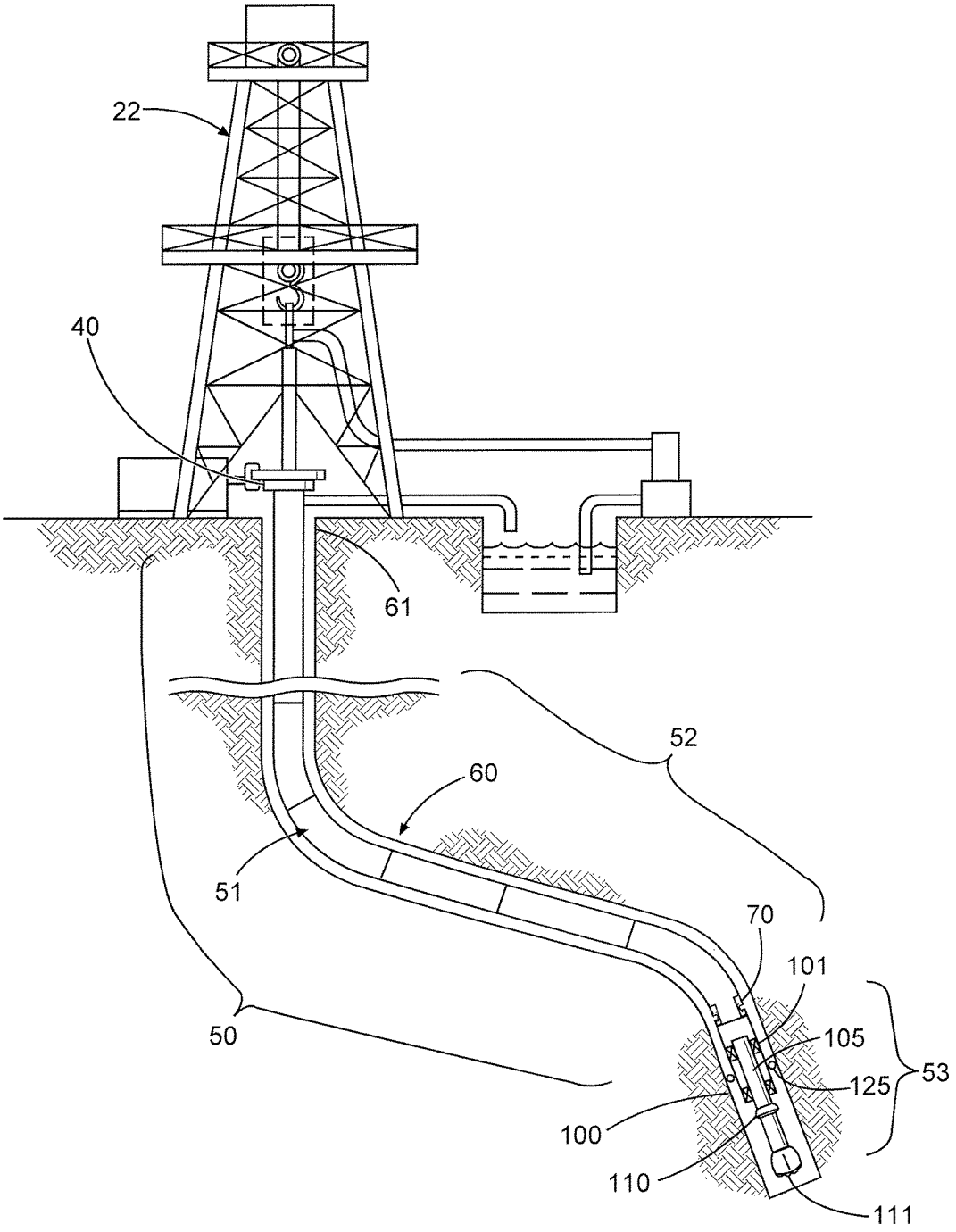
FIG. 1A is a schematic side view in section and in elevation with portions broken away showing one example of a directional wellbore which may be formed in accordance with aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

Illustrative embodiments of the present disclosure are described in detail herein. In the interest of clarity, not all features of an actual implementation may be described in this specification. It will of course be appreciated that in the development of any such actual embodiment, numerous implementation-specific decisions are made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the disclosure. Embodiments of the present disclosure may be applicable to horizontal, vertical, deviated, multilateral, u-tube connection, intersection, bypass (drill around a mid-depth stuck fish and back into the well below), or otherwise nonlinear wellbores in any type of subterranean formation. Embodiments may be applicable to injection wells, and production wells, including natural resource production wells such as hydrogen sulfide, hydrocarbons or geothermal wells; as well as borehole construction for river crossing tunneling and other such tunneling boreholes for near surface construction purposes or borehole u-tube pipelines used for the transportation of fluids such as hydrocarbons. Embodiments described below with respect to one implementation are not intended to be limiting.

The terms "couple" or "couples" as used herein are intended to mean either an indirect or a direct connection. Thus, if a first device couples to a second device, that connection may be through a direct connection or through an indirect mechanical or electrical connection via other devices and connections. Similarly, the term "operatively coupled" as used herein is intended to mean either a direct or an indirect connection that enables a particular operation or operations, as explained by the context in which "operatively coupled" is used. For example, a drill string may be operatively coupled to a drill bit so as to impart rotational forces upon the drill bit when the drill string is rotated. In this context, then, "operatively coupled" means that the drill bit is directly or indirectly connected to the drill string in a manner that enables rotational forces imparted to the drill string to be transferred to the drill bit. As another example, a drill bit may be operatively coupled to a BHA so as to enable the BHA to effect an axial deviation of the drill bit—in this instance, "operatively coupled" means that the drill bit is directly or indirectly connected to the BHA in a manner that enables the BHA to deviate the drill bit in an axial manner (e.g., with respect to the drill string).

The present disclosure relates generally to subterranean drilling operations and, more particularly, to directional drilling operations and tools therefor.

The present disclosure in some embodiments provides methods, systems, and apparatuses for effecting directional drilling, in particular in a casing while drilling operation and/or a liner drilling operation. According to aspects of the present disclosure, directional drilling may be accomplished by a rotary steerable system ("RSS"), which may include means for deviating a drill bit radially from the axis of a drill string in either a "point-the-bit" or a "push-the-bit" manner. In casing while drilling operations according to some embodiments, a casing string is used as the drill string (e.g., instead of drilling pipe, the casing string itself is rotated and imparts rotation to a drill bit disposed at a downhole or lower end of the casing string, such that as drilling proceeds, the casing string is lowered into the borehole).

The RSS according to some embodiments may be coupled to the drill string, and in certain embodiments involving direction casing-while-drilling, the RSS may be coupled to the casing string such that the RSS is disposed within the casing string. The RSS in some embodiments may be part of, or otherwise included in, a BHA. The RSS may be coupled to an under-reamer and/or a drill bit disposed at the downhole or lower end of the casing string.

Certain embodiments according to the present disclosure may include directional liner drilling. A "liner" is a particular kind of casing string which does not extend to the top of the borehole. Thus, in liner drilling according to some aspects of the present disclosure, the drill string may comprise drill pipe coupled to the liner, which in turn is coupled to the RSS (which likewise may be part of or otherwise included in a BHA). The RSS of such embodiments may likewise be disposed within the liner, and coupled to an under-reamer and/or a drill bit disposed at the downhole or lower end of the liner. Some differences between liner and more generic forms of casing are discussed in greater detail below, but in general, descriptions of embodiments involving casing-while-drilling may be equally applicable to embodiments involving the particular sub-category of liner drilling, wherein the casing string comprises a liner string. In some embodiments, the casing string may be substituted with a drill string comprising drill pipe and liner.

For example, FIG. 1A is a diagram illustrating directional casing while drilling according to aspects of the present disclosure. FIG. 1A depicts a BHA 100 disposed at a lower or downhole end of a casing string 50 being used as the drill string. The BHA 100 also includes an under-reamer 110 and drill bit 111 disposed at the lower or downhole end of the casing string 50. Although the drill bit 111 and under-reamer 110 are shown as separate elements in the embodiment depicted in FIG. 1A and in certain other embodiments depicted herein, a drill bit 111 according to some embodiments may itself comprise a reamer, and/or a drill bit 111 may comprise any suitable means of boring or enlarging a hole to substantially equal the outer diameter of a casing string 50 (e.g., a bi-center bit). The BHA 100 of FIG. 1A includes an RSS 105 disposed within the casing string 50. The RSS 105 may be coupled to the casing string 50 by, for example, one or more sets of latches 101. The RSS 105 may additionally be operatively coupled to the under-reamer 110 and/or drill bit 111 in a manner such that the RSS 105 may impart rotation to the under-reamer 110 and/or drill bit 111. In some embodiments, the RSS 105 may also be operatively coupled to the casing string 50 in a manner that enables rotation imparted to the casing string 50 to be imparted to the RSS 105, and to in turn be imparted to the under-reamer 110 and/or drill bit 111. For example, as will be explained in more detail below, in one embodiment, the casing string 50 itself may be rotated (e.g., by top drive 40 at rig 22), which in turn will rotate the RSS 105, which in turn will impart rotation to the under-reamer 110 and/or drill bit 111. In another example embodiment, also explained in more detail below, only some part or parts of the RSS 105 may be operatively coupled to the casing string 50 such that rotational forces from the casing string 50 are imparted only to the operationally coupled parts of the RSS 105, and in turn to the under-reamer 110 and/or drill bit 111. In such embodiments, some portions of the RSS 105 (e.g., its housing and components disposed thereon) are substantially non-rotating.

In some embodiments, the BHA 100 may include a mud motor (not shown in FIG. 1A), which may be actuated or otherwise activated so as to impart rotational forces upon the drill bit, as will be apparent to one having skill in the art with the benefit of this disclosure. In such embodiments, the rotation from the mud motor may be either in addition to or instead of the rotation imparted to the drill bit by rotating the casing string 50.

In some embodiments, as illustrated by the example depicted in FIG. 1A, the casing string 50 may comprise multiple casing joints 51. Each casing joint 51 may be a segment of casing pipe serially coupled to one or more other casing joints 51. Casing joints may in some instances be of approximately equal length, and include means for coupling to other casing joints on either end (e.g., threading for threaded connection either directly to another casing joint or for connection to a casing joint connector capable of receiving threaded ends of two casing joints). As illustrated in FIG. 1A, a casing string 50 may extend from the top of the borehole 60 (e.g., point 61 in FIG. 1A) to a downhole point 63 of the borehole 60. Some wells drilled according to certain embodiments of the present disclosure may involve the use of multiple casing strings, in which case each casing string would extend from the top of the borehole 60 to a point downhole, which downhole point may be different for each casing string.

For example, where a subsequent casing string is run through a previously deposited casing string and further into the hole as the hole is drilled deeper, the second casing string may extend from the surface of the borehole to a deeper downhole point, not shown in FIG. 1A. Multiple casing string drilling may include two, three, or more instances of casing while drilling effected through one or more previously deposited casing strings, wherein the casing used as the current drilling string at any point in time has a diameter small enough that it is capable of being threaded through the smallest-diameter casing already deposited in the borehole.

In some embodiments, the casing string 50 may further include a swivel, illustrated by the stylization of a swivel 70 shown in FIG. 1A. A swivel 70 may in some embodiments include any suitable mechanism for coupling two casing joints 51 in a manner that rotational forces from casing joints 51 above the swivel 70 are not transferred to a casing joint or joints 51 below the swivel (e.g., the casing joints 51 below the swivel 70 could be thought of as hanging freely from the portion of the casing string 50 above the swivel 70). Thus, in embodiments wherein the casing string 50 includes a swivel 70, the casing string 50 may be defined to include an upper section (e.g., upper section 52) and a lower section (e.g., lower section 53), wherein the upper section includes the casing joint or joints above the swivel 70 and the lower section includes the casing joint or joints below the swivel 70. In such embodiments, the RSS 105 may be disposed at least in part within, and/or coupled to, the lower section 53 of the casing string 50.

In some embodiments including a swivel, the casing string 50 may additionally include one or more centralizers 125 disposed along a portion of the casing string 50 within which the RSS 105 is disposed. These centralizers may help the casing string 50 maintain an approximately centered position in the borehole 60.

Figure 7:
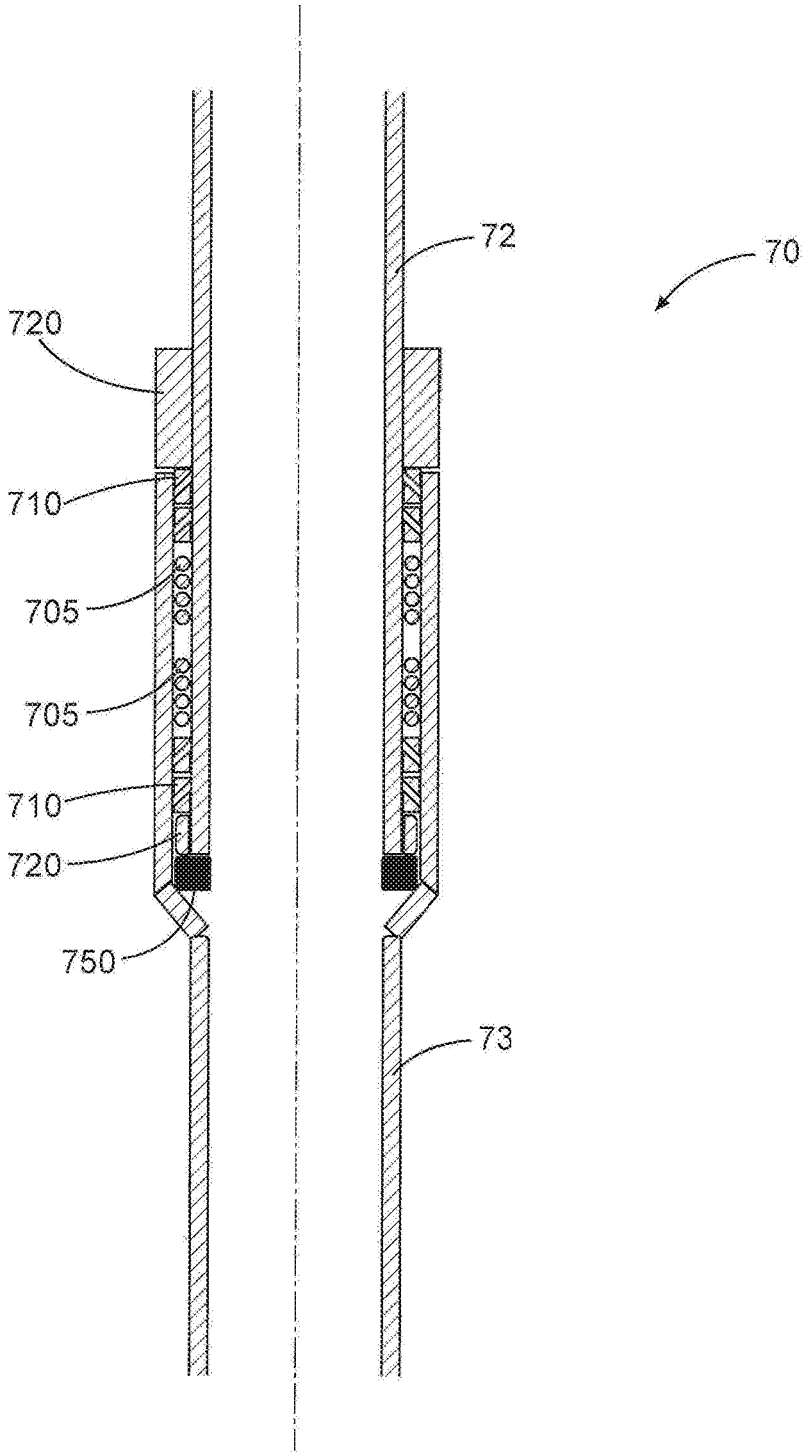
FIG. 7 is a diagram illustrating a cross-sectional detail view of components of a swivel according to some embodiments.

As noted, the swivel 70 may include one or more mechanisms that enable coupling of two casing joints 51 in a manner that rotational forces from casing joints 51 above the swivel 70 are not transferred to a casing joint or joints 51 below the swivel. For instance, the swivel 70 may include one or more radial force bearing components, one or more axial force bearing components, and a sealing mechanism. One example illustration of a swivel 70 according to some embodiments is shown in FIG. 7, which is a diagram illustrating a cross-sectional detail view of components of a swivel 70 according to some embodiments. The swivel 70 includes the coupling of two casing joints—an upper casing joint 72 of the upper section 52 of the casing string and a lower casing joint 73 of the lower section 53 of the casing string—by way of one or more radial bearings 705 and one or more thrust bearings 710. The radial bearings 705 serve as radial force bearing components and the thrust bearings 710 serve as axial force bearing components. Each of the radial bearings 705 and the thrust bearings 710 enable rotation of the casing joints 72 and 73 relative to each other even when either or both of radial and axial forces are being transmitted between the casing joints 72 and 73 via the bearings. The swivel 70 may also include one or more axial load transfer blocks 720 that likewise enable transfer of axial (that is, uphole or downhole) forces between the two casing joints 72 and 73. Moreover, the swivel 70 of FIG. 7 also includes a rotary seal 750 that acts as a sealing mechanism, maintaining fluid integrity within the casing string notwithstanding any gaps between the two casing joints 72 and 73 in which the various bearings 705 and 710 are disposed. The inner diameter of the casing joints 72 and 73 at the swivel 70, like the inner diameter of any other casing joint 51, may be sufficiently large to accommodate passage of any one or more of an underreamer 110, a drill bit 111, and a BHA 100 through the casing joints 72 and 73 at the point of the swivel 70.

In some embodiments, the RSS may be coupled to a liner (not shown in FIG. 1A). As noted above, "liner" is a particular kind of casing string which does not extend to the top of the borehole (e.g., point 61 in FIG. 1A), and instead is hung from a point along a previously positioned casing string. A liner may be used in multiple casing string drilling in a manner similar to those described herein with respect to casing-while-drilling, except that instead of using a full casing string as the drilling string, in liner drilling a partial conventional drilling string (e.g., drill pipe rather than casing) is coupled to the liner at a lower or downhole end of the drill pipe, and the liner is in turn coupled to the RSS. Drilling may commence and proceed in a manner similar to casing-while-drilling scenarios described herein, except that as the liner-drilling stage nears completion, the liner may be received by latches or other means of coupling the liner to the previously deposited casing string at some point along the previously deposited casing string. The liner may comprise multiple liner joints (similar to a casing string comprising multiple casing joints). In some embodiments, any two of the liner joints may be coupled by a swivel such that the liner comprises a swivel disposed thereon. In such embodiments, the upper section of the liner string may include any liner joints above the swivel plus the drill pipe, while the lower section of the liner string may include the liner joint(s) below the swivel, and to which rotation of the upper assembly may not be imparted. Thus, the drill string may be rotated without substantially rotating a lower section of the liner.

Thus, although some embodiments herein may be described as comprising a swivel 70, an upper section of a casing string 52, and a lower section of a casing string 53, the description may be put in more generic terms as referring to a drilling string comprising a swivel 70, which defines an upper section of the drilling string above the swivel 70, and a lower section of the drilling string below the swivel 70. The drilling string may comprise a casing string 50 (as with embodiments previously discussed and as with some embodiments discussed below), or it may in other embodiments comprise drill pipe and a liner.

In some embodiments, either of a casing string 50 or a liner string may include an inner string (e.g., an inner casing string or an inner liner string) coupled to the RSS 105 and/or BHA 100. The inner string fits within the casing string 50 or liner string, as applicable, and permits removal of the RSS 105 and/or BHA 100 up through the casing or liner at completion of the drilling of each section of the borehole. In other embodiments, the RSS 105 and/or BHA 100 may be retrieved through the casing or liner at the completion of drilling each section via wireline, coiled tubing, or the like lowered into the hole and coupled to the RSS 105 and/or BHA 100, or by tripping a pipe or other string into the hole and coupling to the RSS 105 and/or BHA 100.

Figure 1B:
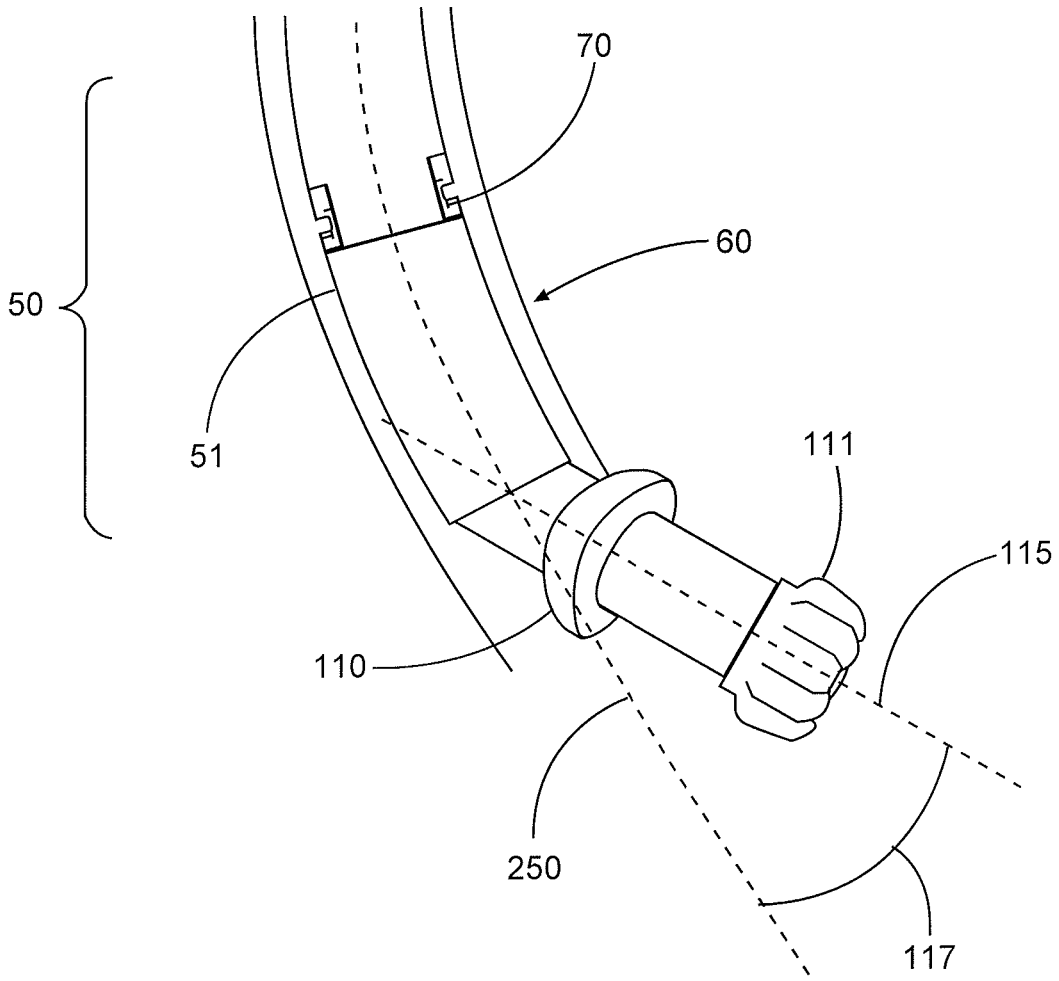
FIG. 1B is a close-up side view with portions broken away showing one example of directional drilling in accordance with aspects of the present disclosure.

FIG. 1B is a diagram illustrating the drill bit 111 and under-reamer 110 of FIG. 1A engaged in a point-the-bit type directional drilling operation according to aspects of the present disclosure. The portion of the BHA 105 including the under-reamer 110 and drill bit 111 protrudes from the casing string 50. It can be seen that the longitudinal drilling axis 115 of each of the under-reamer 110 and drill bit 111 is radially diverted from the longitudinal axis 116 of the borehole at an offset angle 117. The angle 117 is exaggerated as shown in FIG. 1B for purposes of illustration; it is not necessary (although possible) that so large an offset angle 117 be used to effect directional drilling. "Radial diversion" as used herein may include either or both of: (1) inclination, which corresponds to the offset angle between the longitudinal axis of the borehole and the longitudinal axis of the drill bit (e.g., angle 117 between the borehole axis 116 and drill bit axis 115, as shown in FIG. 1B); and (2) azimuthal direction, which corresponds to the angular orientation of the drill bit relative to the longitudinal axis of the borehole (that is, the direction in which the inclination departs from the longitudinal axis of the borehole).

Furthermore, as shown in FIG. 1B, the longitudinal axis of the casing string 250 is approximately equal to the longitudinal axis of the borehole; thus, directional drilling in the point-the-bit style, as shown in FIG. 1B, may in some embodiments include radial diversion of the drill bit relative to the longitudinal axis 250 of both the borehole and the casing string. Directional drilling according to push-the-bit type embodiments, on the other hand, may involve no movement of the drill bit longitudinal axis relative to the casing string axis 250, and instead may be effected by radially diverting both the drill bit and the casing string off of the longitudinal axis of the borehole in a manner such that both the drill bit and the casing string maintain approximately the same longitudinal axis.

FIG. 2 shows an example RSS according to some embodiments of the present disclosure. The RSS of FIG. 2 includes a substantially non-rotating RSS housing 201 coupled to the casing (here, lower section of casing 53) by means of a first set of latches 210 and a second set of latches 215. Thus, the RSS housing 201 may be rotationally fixed relative to the lower section of casing 53, such that it rotates with the same speed and direction as the casing 53. In some embodiments, one or more centralizers (not shown in FIG. 2) may be used in place of either or both sets of latches the second set of latches 215. A centralizer may allow the RSS housing 201 to rotate relative to the casing, while still holding the housing 201 centered within the casing (whereas a latch locks the RSS housing 201 to the casing, thereby preventing rotation of the RSS housing 201 relative to the casing). A drive shaft 314 may be received by, and at least partially disposed within, the RSS housing 201. The drive shaft 314 may be operatively coupled to the under-reamer 110 and/or drill bit 111 so as to enable radial diversion of the under-reamer 110 and/or drill bit 111 with respect to the longitudinal axis of the casing string 250.

Figure 3:
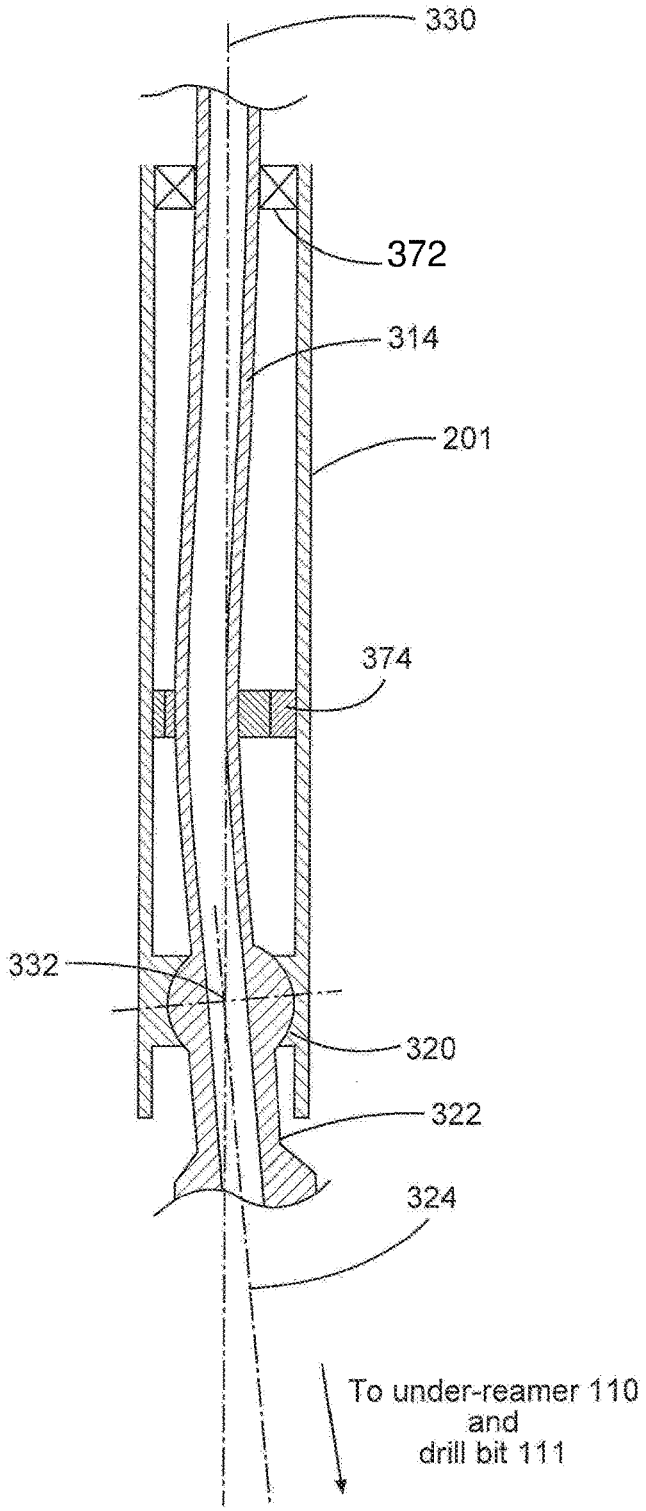
FIG. 3 is a diagram with portions broken away illustrating an example rotary steerable system according to aspects of the present disclosure.

FIG. 3 is a diagram illustrating a cross-sectional partial break-away view of a highly simplified example of a drive shaft 314 received within the RSS housing 201. The drive shaft of FIG. 3 is a flexible drive shaft 314 with an upper portion held centered within the RSS housing 201 by an upper focal point 372. A focal point, such as focal point 372, may maintain portions of the flexible drive shaft 314 centered within the housing 201, while still enabling the drive shaft 314 to rotate relative to the substantially non-rotating RSS housing 201. Focal point 372 in FIG. 3 is an upper bearing assembly. FIG. 3 also includes a lower focal point 320, which similarly holds the drive shaft 314 centered at the point where the focal point 320 receives the drive shaft 314. The lower focal point 320 of FIG. 3 is illustrated as a spherical bearing assembly 320.

The RSS of FIG. 3 may operate in a point-the-bit manner. While steering, directional control is achieved by radially deflecting the rotating drive shaft 314 in a particular direction and at a particular magnitude within the substantially non-rotating housing 201, at a point between the upper focal point (e.g., upper bearing assembly 372) and lower focal point (e.g., spherical bearing assembly 320). Radial deflection of the flexible drive shaft 314 within the housing may be effected by any of various mechanisms. For example, the flexible drive shaft 314 may be deflected by one or more drive shaft actuators 374. A drive shaft actuator may include any suitable means for deflecting the drive shaft 314. For example, a drive shaft actuator may in some embodiments include a double eccentric ring cam unit. Other diversion mechanisms may be employed in other embodiments, such as a plurality of actuators that may be selectively and independently triggered so as to achieve a particular degree and direction of diversion of the drive shaft 322 from the center of the housing 201 at the point where the actuators receive the shaft 322.

The drive shaft actuator 374 of FIG. 3 causes the drive shaft's lower end 322 to pivot about the spherical bearing assembly 320 by radially deflecting the drive shaft 314 at the point where the drive shaft actuator 374 receives the shaft 314. The spherical bearing assembly 320 constrains the rotating shaft 314 to the non-rotating housing 201 in the axial and radial directions while allowing the drive shaft 314 to pivot with respect to the non-rotating housing 201. The longitudinal axis 330 of the housing may also be equivalent to the longitudinal axis of the casing string 250, and the lower shaft axis 324 may also be the longitudinal axis of the under-reamer and/or drill bit coupled to the drive shaft. Thus, the above-described deflection and pivoting of the drive shaft 314 results in radial diversion of the longitudinal axis 324 of the under-reamer and/or drill bit from the longitudinal axis 330 of the casing and RSS housing. The intersection of the longitudinal axis 330 of the housing and the longitudinal axis 324 of the pivoted shaft below the spherical bearing assembly defines the bend 332 for directional drilling purposes. While steering, the bend 332 is maintained in a desired toolface and bend angle by the drive shaft actuator 374. To drill straight, the drive shaft actuator 374 is arranged so that the deflection of the shaft is relieved and the central axis of the shaft below the spherical bearing system 324 is put in line with the longitudinal axis of the housing 330 and casing 250.

Figure 2A:
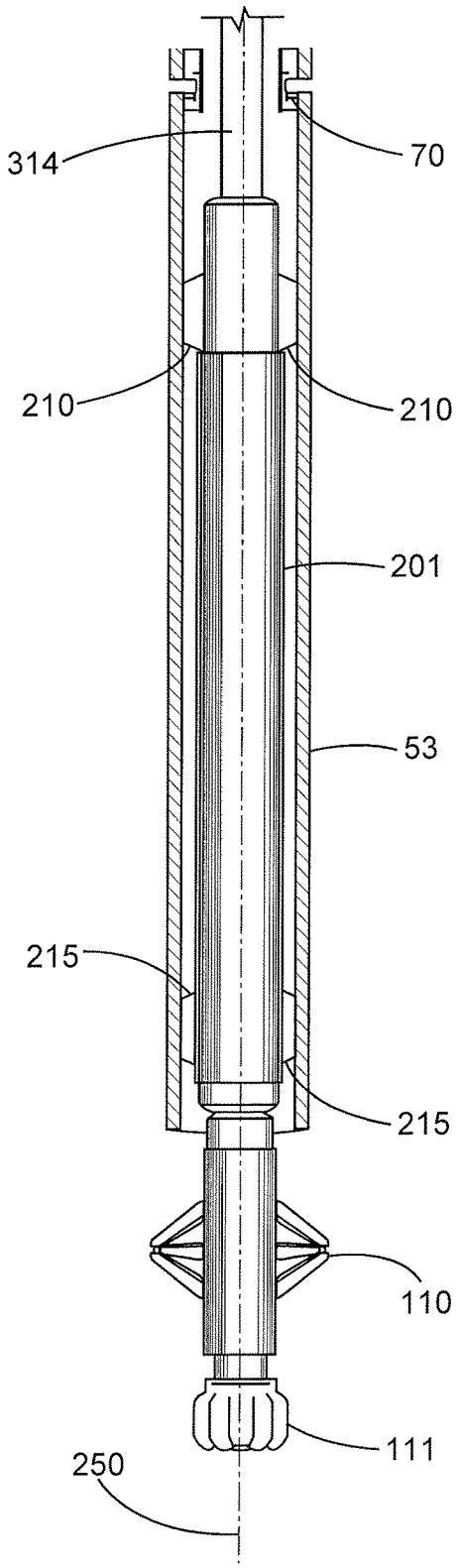
FIG. 2A is a diagram illustrating an example rotary steerable system in casing, according to aspects of the present disclosure.

Returning to FIG. 2, the RSS housing 201 of some embodiments may be coupled to a lower, substantially non-rotating section of the casing string 53 located below a swivel 70 on the casing string. As previously noted, the swivel 70 may be a connection between two casing joints that enables coupling of the two casing joints, but that does not impart rotational forces from the upper casing joint to the lower casing joint. Thus, the upper section 52 of the casing string (i.e., that located above the swivel 70) may receive rotational forces from, e.g., a top drive, while the lower section 53 of the casing string (i.e., that section below the swivel) does not receive such rotational forces. The RSS housing 201 in some embodiments may be disposed entirely within, and coupled to, the lower section 53 of the casing string, as illustrated in FIG. 2A. Moreover, the flexible drive shaft 314 may extend in an upward direction (that is, in a direction toward the surface along the casing string) from the RSS housing 201 and be operatively coupled to the upper section of the casing string (not shown in FIG. 2) above the swivel 70 in a manner that enables the rotation of the upper section of the casing string to be imparted to the drive shaft 314, and in turn to the under-reamer 110 and/or drill bit 111, to which the drive shaft 314 is operatively coupled. The swivel 70, while not transferring rotational forces to the RSS housing 201 and lower section of the casing string 53, does enable steering forces to act upon the lower section of the casing string 53, thereby allowing the casing string to be diverted radially from the longitudinal axis of the borehole. In this way, directional drilling may be achieved without rotation of the lower section of the casing string 53, thereby preventing a spiral-type effect resulting from the rotation of the drill bit by way of rotating the upper portion of the casing string. In other words, the drill bit and/or under-reamer may rotate only about the longitudinal axis of the drill bit and/or under-reamer, while not rotating about the axis of the casing string. Furthermore, no counter-rotating motors or other means of effecting counter-rotation in the RSS and lower section of the casing string 53 are necessary to prevent the rotation of such components.

Figure 2B:
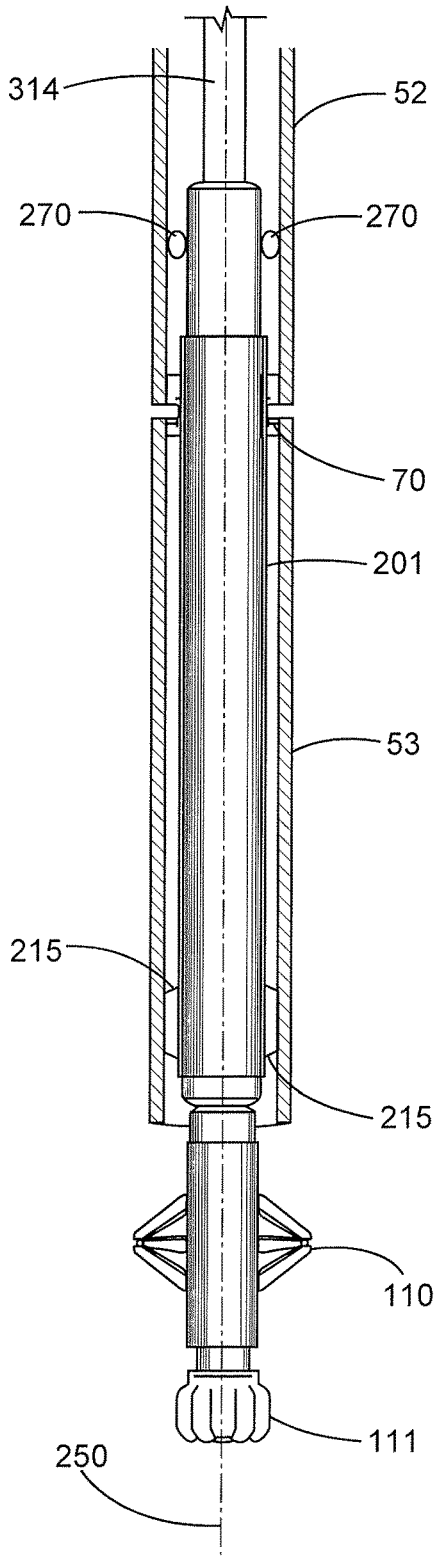
FIG. 2B is a diagram illustrating an example rotary steerable system in casing, according to aspects of the present disclosure.

In some embodiments, as depicted in FIG. 2B, the RSS housing 201 may traverse the swivel 70. That is, a portion of the RSS housing 201 may extend into the upper section 52 of the casing string. In such embodiments, rather than an upper set of latches, a set of roller bearings 270 may couple the RSS housing 201 to the upper section 52 of the casing above the swivel 70 in a manner that enables the upper section 52 of the casing to rotate relative to the RSS housing 201, while holding the RSS housing 201 substantially centered within the upper section 52 of the casing. The RSS housing 201 of such embodiments is still coupled to the lower section 53 of the casing in a manner that prevents rotation of the RSS housing 201 relative to the lower section 53 of the casing, e.g. by lower latches 215. One or more additional sets of lower latches (not shown) may be included to more firmly couple the RSS housing 201 to the lower section 53 of the casing. An RSS according to such embodiments may advantageously allow for a minimized length of the non-rotating lower section 53 of the casing, which may help reduce stick/slip and other drilling and/or steering difficulties.

Further, the non-rotating RSS housing 201 advantageously permits the inclusion of instrumentation, which must normally be placed on non-rotating components, due to the usual variation in rotational speed encountered in drilling, which would degrade the accuracy of many instrument measurements. Accordingly, in some embodiments the RSS housing 201 may include instrumentation such as measuring-while-drilling (MWD) instrumentation (which may equivalently be referred to as logging-while-drilling (LWD) instrumentation), disposed on the housing 201. Such MWD or LWD instrumentation may be capable of sensing one or more parameters related to the drilling operation, such as any one or more of properties of the subterranean formation and properties of the drill string and/or drill bit (e.g., pressure-on-bit, azimuth, inclination). Examples of such instrumentation include gamma sensors, pressure-while-drilling measurement tools, and gyroscopic measuring tools (e.g., means for measuring either or both of inclination and azimuth of the drill string and/or bit). The instrumentation disposed on the RSS housing 201 should, in some embodiments, be such that it will not be adversely affected by the casing surrounding the RSS. The non-rotating nature of the RSS housing 201 and/or the housing's lack of operative coupling to the drill bit 111 and/or under-reamer 110 advantageously may prevent or at least significantly reduce vibrational forces from the drill bit 111 and/or under-reamer 110 from being carried into the instrumentation, as the operative coupling of the drill bit 111 and under-reamer 110 to the drive shaft 314 within the housing 201, but not to the housing 201, results in such forces being carried past the housing 201 and up to the upper section of the casing string 52, above the swivel 70. This could, in some embodiments, result in increased accuracy of measurements taken by the instrumentation, and/or longer life spans of the instrumentation equipment, relative to instrumentation disposed on a rotating RSS or on other rotating and/or vibrating components of the drill string.

Figure 4:
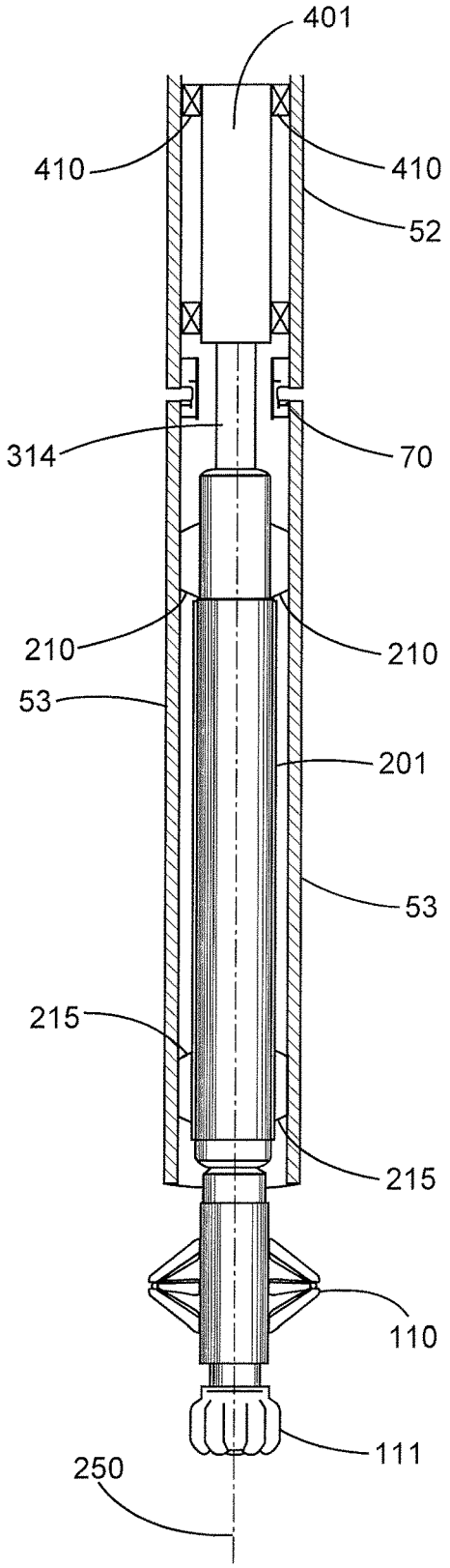
FIG. 4 is a diagram illustrating another example rotary steerable system in casing, according to aspects of the present disclosure.

Referring to FIG. 4, the present disclosure in some embodiments may further comprise a mud motor 401 operatively coupled to the drive shaft 314 of the RSS 105 and to the upper section of the casing string 52 (e.g., by latches 410). The mud motor 401 may be located above the swivel 70, as shown in FIG. 4, although in other embodiments, the mud motor 401 may be located below the swivel 70. The mud motor 401, wherever located, may be operatively coupled to the drive shaft 314 of the RSS 105. The mud motor 401 may be capable of actuation (e.g., by passing drilling mud through the motor, by sending an electrical signal, or by any other means) so as to impart rotation to the drive shaft 314 and, in turn, the under-reamer 110 and bit 111. The mud motor 401 may provide rotation instead of or in addition to the rotational forces imparted to the drive shaft 314 (and, in turn, the under-reamer 110 and/or drill bit 111) by rotating the upper section of the casing string 405.

Figure 5A:
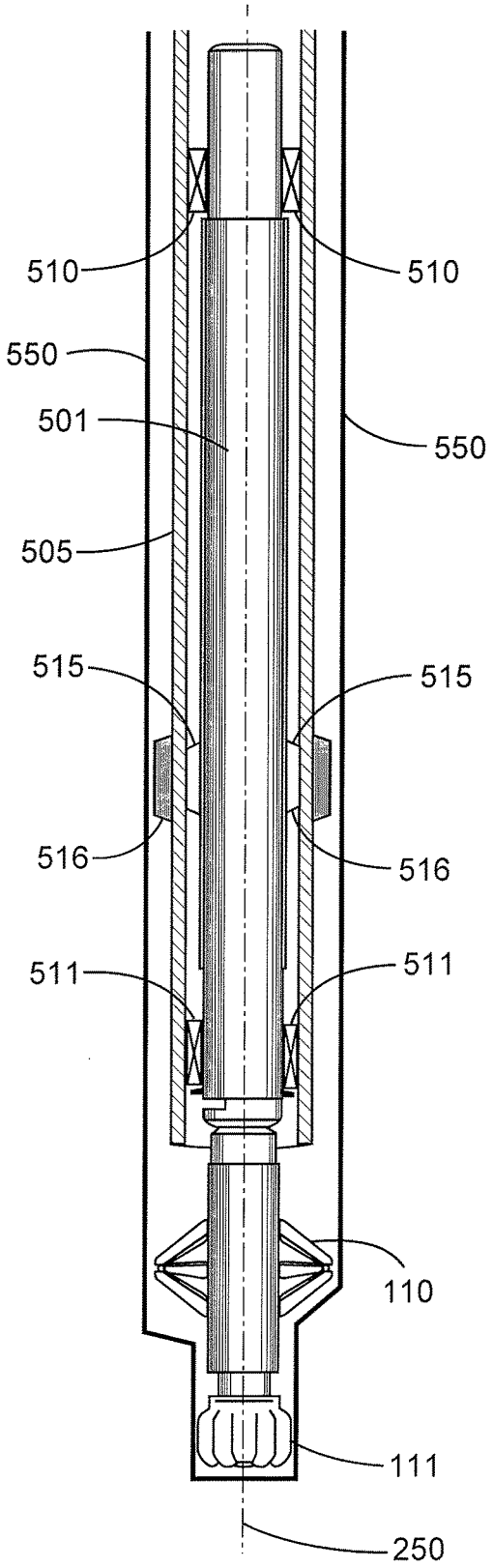
FIG. 5A is a diagram illustrating another example rotary steerable system in casing and within a borehole, according to aspects of the present disclosure.
Figure 5B:
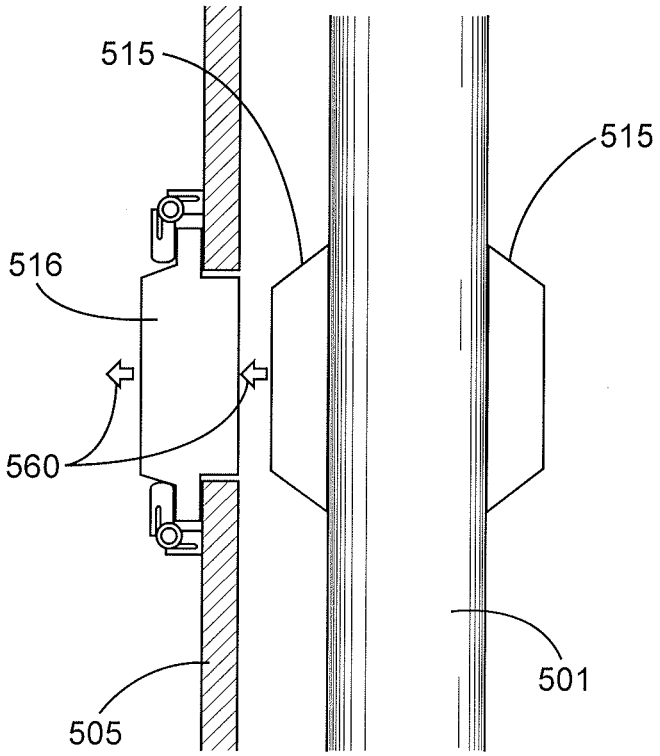
FIG. 5B is a diagram illustrating RSS and casing pads, according to aspects of the present disclosure.

FIG. 5A is a cross-sectional view of another example embodiment of an RSS according to aspects of the present disclosure. The RSS of FIG. 5A operates in a push-the-bit manner. It includes an RSS housing 501 latched to the casing 505 by two sets of latches 510 and 511 respectively disposed near each of an upper and lower end of the RSS housing 501. The casing 505 may be standard casing or it may be liner, according to some embodiments. The RSS housing 501 further includes a set of RSS pads 515 disposed at a point along the length of the RSS housing 501. A set of casing pads 516 is disposed along the casing 505 at a location that enables each casing pad 516 to be engaged by at least one corresponding RSS pad 515 within the casing. Each casing pad 516 is capable of being pushed outward from the outer wall of the casing into the borehole when engaged by its corresponding RSS pad 515. In this and similar configurations, then, some embodiments of the present disclosure enable one or more RSS pads 515 to be actuated so as to push outward against the corresponding casing pad(s) 516 engaged by the actuated RSS casing pad(s) 515. This steering force is in turn transmitted into the borehole wall 550 through the casing pad(s) 516, e.g., by way of the casing pad(s) 516 pushing against the borehole wall 550. This push against the borehole wall 550 results in pushing the casing 505 (including latched RSS) away from the portions of the borehole wall 550 pushed against by the pad(s) 516, thereby resulting in radial diversion of the casing from the longitudinal axis of the borehole. In embodiments involving liner drilling (e.g., where casing 505 is specifically liner), the casing pads 516 may likewise be deployed on the liner. FIG. 5B is a cross-sectional diagram illustrating a simplified example of an RSS pad—casing pad assembly according to some aspects of the present disclosure. It shows RSS pad 515 operable to be actuated so as to extend in a radially outward direction 560 from the RSS housing 501, so as to engage a corresponding casing pad 516 disposed along the casing 505. The casing pad 516 in turn pushes in the same radially outward direction 560 toward the borehole wall (not shown in FIG. 5B).

Notably, in this and similar configurations, the RSS does not move relative to the casing by virtue of the latches holding it in place, thereby ensuring that steering forces directed through the RSS pad(s) 515 are in turn translated to the casing pad(s) 516 pushing against the borehole wall 550. Furthermore, unlike in the point-the-bit embodiments, the longitudinal axis of the under-reamer and/or drill bit is not diverted from the longitudinal axis of the casing string (and RSS housing); instead, the respective longitudinal axes of the bit, under-reamer (if present), casing string, and RSS housing, remain substantially equivalent, and are diverted radially with respect to the borehole's longitudinal axis.

Figure 6:
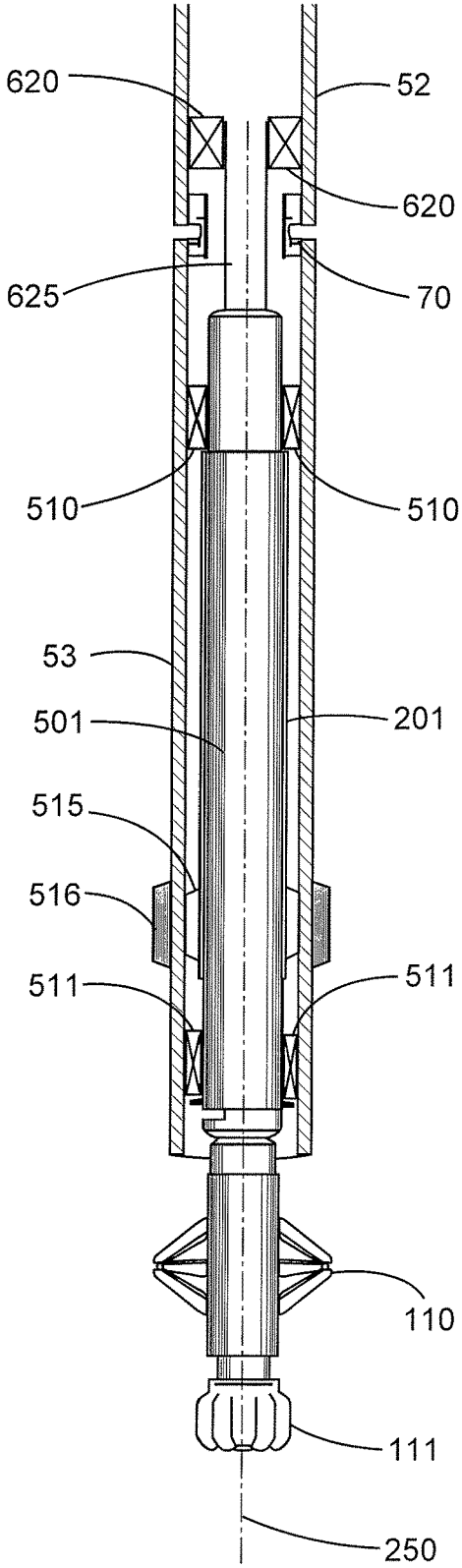
FIG. 6 is a diagram illustrating another example rotary steerable system in casing and within a borehole, according to aspects of the present disclosure.

In some push-the-bit embodiments, the RSS housing 501 may rotate with the casing (even though it does not rotate relative to the casing). In such embodiments, then, as the casing rotates the RSS pad(s) 515 being actuated may change dynamically so as to maintain the casing in a radially diverted position for steering the drill bit in a single direction. In other push-the-bit embodiments, the RSS housing 501 and a portion of the casing to which it is coupled may be substantially non-rotating. Such embodiments may be described by reference to FIG. 6, in which the RSS housing 501 is coupled to one or more casing joints along a lower casing section 53 comprising all casing joint(s) below a swivel 70 along the casing string. Similar to the embodiments depicted in FIGS. 2A and 2B, the RSS housing 501 of such embodiments may be disposed entirely below the swivel 70, or it may be disposed in the casing in a manner in which it traverses the upper and lower sections 52 and 53 of the casing, while being coupled to an upper section 52 of the casing in a manner that enables the upper section 52 of the casing to rotate relative to the RSS housing 501. As shown in FIG. 6, the RSS housing 501 is disposed in the lower section 53 of the casing. The RSS housing 501 may receive a rigid drive shaft 625 in a manner similar to the receiving of the flexible drive shaft 314 described previously with respect to some embodiments. The rigid drive shaft 625 of embodiments according to FIG. 6 may be operatively coupled to an upper casing section 52 above the swivel 70 (e.g., by latches 620). The rigid drive shaft 625 is operatively coupled to the upper casing section 52 so that rotation of the upper casing section 52 is imparted to the rigid drive shaft 625. The rigid drive shaft 625 may be received by the RSS housing 501 in a manner such that it is held radially centered within the RSS housing 501 (e.g., by one or more bearing assemblies in a manner similar to that described with respect to embodiments according to FIGS. 2A-4). The rigid drive shaft 625 may pass through the RSS housing 501 and be operatively coupled to the under-reamer 110 and/or drill bit 111 downhole from the RSS housing 501, in a manner that enables the rotation of the upper casing section 52 to be imparted to the rigid drive shaft 625 and in turn to the under-reamer 110 and/or drill bit 111. The longitudinal axis of the casing string may be diverted relative to the longitudinal axis of the borehole, e.g., in a manner similar to that described with respect to the description of the pads 515 and 516 of FIGS. 5A and B. As with embodiments according to the description of FIGS. 2A-4, the substantially non-rotating nature of the lower casing section 53 may advantageously prevent a spiral drilling pattern resulting from directional steering in casing while drilling applications. Likewise similar to previous discussion with respect to other embodiments, the substantially non-rotating configuration of the RSS housing 501, and the operative coupling of the under-reamer 110 and/or drill bit 111 to the rigid drive shaft 625 but not to the RSS housing 501, furthermore may enable various MWD or other instrumentation to be disposed upon the RSS housing 501 without fear of detrimental effects caused by vibrational, rotational, and other forces.

Furthermore, in embodiments including a swivel 70 and casing pads 516, a casing centralizer 125 as previously described may not be necessary, as the casing pads 516 may serve the function of holding the casing approximately centered within the borehole (e.g., when no diversion is applied through actuation or the like). Nonetheless, even when casing pads 516 are included, some embodiments may additionally include a centralizer 125 located along the casing string 50, either along the portion in which the RSS 105 is disposed, or higher up the casing string.

Some embodiments of the present disclosure, as described above, provide an RSS disposed within the casing or liner. This presents several advantages over drilling systems and methods utilizing an RSS disposed below the casing, such as systems and methods wherein an RSS is included in a BHA disposed below the casing. For example, the pilot hole (the portion of the borehole drilled below the casing) is much deeper where the entire RSS assembly protrudes below the casing, and the drill bit in turn protrudes below the RSS. Indeed, in some circumstances wherein the BHA further includes instrumentation (such as MWD instrumentation) disposed below the casing, the pilot hole may be on the order of 100 feet long or longer. This long pilot hole can prevent the casing or liner from being placed at or close to the bottom of the drilled section. Detrimental effects from this situation may include, e.g., reduced integrity of the cased borehole. Furthermore, where the RSS extends below the casing, it may suffer increased wear and tear (and therefore reduced lifespan, and/or the need for sturdier construction) due to its being in contact with the formation during drilling operations. In some embodiments according to the present disclosure, on the other hand, the distance between the bottom or lower end of the drill bit and the bottom or lower end of the casing string may be as little as 5 feet, or less. In some embodiments, the distance may be 10 feet or less; in other embodiments, the distance may be less than or equal to any one of the following: 11, 12, 13, 14, 15, 16, 17, 18, 19, 20, 21, 22, 23, 24, 25, 26, 27, 28, 29, and 30 feet. In some embodiments, the distance may be 50 feet or less.

Accordingly, in some embodiments the present disclosure provides a method comprising: rotating a drill bit in a borehole by rotating an upper section of a casing string without substantially rotating a lower section of the casing string, the upper section of the casing string being operatively coupled to the drill bit; and radially diverting the drill bit from the longitudinal axis of the borehole with a rotary steerable system that is coupled to the lower section of the casing string and disposed at least partially within the lower section of the casing string.

In other embodiments, the present disclosure provides a directional drilling system comprising: a casing string comprising an upper section and a lower section coupled to each other by a swivel; a rotary steerable system disposed at least partially within the lower section of the casing string, the rotary steerable system comprising a housing coupled to the lower section of the casing string; a drive shaft received by the housing such that it is capable of rotating with respect to the housing; and a drill bit coupled to the drive shaft and disposed at a lower end of the lower section of the casing string; wherein the upper section of the casing string is coupled to the drill bit via the drive shaft such that rotation of the upper section of the casing string causes the drill bit to rotate about a longitudinal axis of the drill bit.

In certain embodiments, the present disclosure provides a directional drilling system comprising: a rotary steerable system disposed within a casing string within a borehole, the rotary steerable system comprising a housing coupled to the casing string; one or more RSS pads, wherein each RSS pad is disposed at a point along the housing and is capable of extending radially outward from the housing toward the casing string; and one or more casing pads, each casing pad disposed along the casing string and capable of being engaged by a corresponding RSS pad and displaced radially outward in a direction away from the casing string and toward a wall of the borehole; wherein each RSS pad is capable of being actuated so as to engage its corresponding casing pad, thereby displacing the casing pad such that it pushes against the borehole wall.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that it introduces.

What is claimed is:

1. A method comprising:

rotating a drill bit in a borehole by rotating an upper section of a casing string without substantially rotating a lower section of the casing string, the upper section of the casing string being operatively coupled to the drill bit; and radially diverting the drill bit from the longitudinal axis of the borehole with a rotary steerable system that is coupled to the lower section of the casing string and disposed at least partially within the lower section of the casing string.

2. The method of claim 1 wherein the upper section of the casing string is coupled to the lower section of the casing string by a swivel.

3. The method of claim 1 wherein radially diverting the drill bit comprises radially diverting the longitudinal axis of the drill bit and the longitudinal axis of the casing string from the longitudinal axis of the borehole.

4. The method of claim 3 wherein the rotary steerable system comprises one or more RSS pads, each of which engages a casing pad disposed along the lower section of the casing string, the casing pad capable of extending radially outward from the casing string into the borehole; and wherein radially diverting the drill bit further comprises actuating one or more of the RSS pads such that each actuated RSS pad pushes against its corresponding casing pad, which in turn pushes against a wall of the borehole.

5. The method of claim 1 wherein the casing string comprises a liner string, the upper section of the casing string comprises an upper section of the liner string, and the lower section of the casing string comprises a lower section of the liner string; and wherein the upper section of the liner string is coupled to the lower section of the liner string by a swivel.

6. The method of claim 5 wherein radially diverting the drill bit comprises radially diverting the longitudinal axis of the drill bit and the longitudinal axis of the liner string from the longitudinal axis of the borehole.

7. The method of claim 6 wherein the rotary steerable system comprises one or more RSS pads, each of which engages a casing pad disposed along the lower section of the liner, the casing pad capable of extending radially outward from the liner string into the borehole; and wherein radially diverting the drill bit further comprises actuating one or more of the RSS pads such that each actuated RSS pad pushes against its corresponding casing pad, which in turn pushes against a wall of the borehole.

8. The method of claim 1 wherein radially diverting the drill bit comprises radially deflecting at least a portion of a drive shaft disposed within the rotary steerable system so as to point the drill bit.

9. The method of claim 8 wherein the rotary steerable system comprises one or more drive shaft actuators capable of radially deflecting at least a portion of the drive shaft.

10. The method of claim 1 further comprising sensing one or more parameters related to the drilling operation using instrumentation disposed on a housing of the rotary steerable system.

11. The method of claim 1 wherein an under-reamer is coupled to the drill string between the rotary steerable system and the drill bit.

12. A directional drilling system comprising:

a casing string comprising an upper section and a lower section coupled to each other by a swivel;

a rotary steerable system disposed at least partially within the lower section of the casing string, the rotary steerable system comprising a housing coupled to the lower section of the casing string;

a drive shaft received by the housing such that it is capable of rotating with respect to the housing; and a drill bit coupled to the drive shaft and disposed at a lower end of the lower section of the casing string;

wherein the upper section of the casing string is coupled to the drill bit via the drive shaft such that rotation of the upper section of the casing string causes the drill bit to rotate about a longitudinal axis of the drill bit.

13. The system of claim 12 wherein the rotary steerable system further comprises:

an upper focal point disposed within the housing and holding an upper portion of the drive shaft substantially centered within the housing;

a lower focal point disposed within the housing and holding a lower portion of the drive shaft substantially centered within the housing; and a drive shaft actuator disposed within the housing between the upper focal point and the lower focal point, the drive shaft actuator being capable of radially deflecting the drive shaft at a point between the upper and lower portions of the drive shaft.

14. The system of claim 13 wherein the drill bit does not rotate about a longitudinal axis of the casing string while it is rotating about the longitudinal axis of the drill bit.

15. The system of claim 12 wherein each of the housing and the lower section of the casing string is substantially non-rotating while the drill bit rotates.

16. The system of claim 15 further comprising measuring-while-drilling instrumentation disposed on the housing.

17. The system of claim 12 wherein the distance between a lower end of the drill bit and the lower end of the casing is 20 feet or less.

18. The system of claim 12 wherein the casing string is a liner string.

19. The system of claim 12 further comprising an under-reamer coupled to the drive shaft between the rotary steerable system and the drill bit.

20. A directional drilling system comprising:

a rotary steerable system disposed within a casing string within a borehole, the rotary steerable system comprising a housing coupled to the casing string;

one or more RSS pads, wherein each RSS pad is disposed at a point along the housing and is capable of extending radially outward from the housing toward the casing string; and one or more casing pads, each casing pad disposed along the casing string and capable of being engaged by a corresponding RSS pad and displaced radially outward in a direction away from the casing string and toward a wall of the borehole;

wherein each RSS pad is capable of being actuated so as to engage its corresponding casing pad, thereby displacing the casing pad such that it pushes against the borehole wall.

21. The system of claim 20 wherein the casing string is a liner string.

22. The system of claim 20 wherein the distance between a lower end of the drill bit and the lower end of the casing is 20 feet or less.

* * * * *